US006056600A

United States Patent [19]

Watanabe et al.

[11] Patent Number: 6,056,600

[45] Date of Patent: May 2, 2000

[54] SHIELDED CONNECTOR

[75] Inventors: Yoshinori Watanabe; Takahiro Kawamae, both of Kanagawa, Japan

[73] Assignee: The Whitaker Corporation, Wilmington, Del.

[21] Appl. No.: 09/095,470

[22] Filed: Jun. 10, 1998

[30] Foreign Application Priority Data

Jun. 16, 1997 [JP] Japan ..... 9-175305
Nov. 28, 1997 [JP] Japan ..... 9-344102

[51] Int. Cl.[7] ..... H01R 13/648

[52] U.S. Cl. ..... 439/607; 439/108

[58] Field of Search ..... 439/607, 108, 439/188, 676, 610, 601, 488, 489

[56] References Cited

U.S. PATENT DOCUMENTS

| | | | |
|---|---|---|---|
| 4,512,618 | 4/1985 | Kumar | 339/14 R |
| 4,878,858 | 11/1989 | Dechelette | 439/607 |
| 4,943,244 | 7/1990 | Teck et al. | 439/567 |
| 4,946,400 | 8/1990 | Kawai et al. | 439/79 |
| 5,266,038 | 11/1993 | Nakamura | 439/79 |
| 5,304,069 | 4/1994 | Brunker et al. | 439/108 |
| 5,564,945 | 10/1996 | Domingos et al. | 439/567 |
| 5,637,014 | 6/1997 | Sukegawa et al. | 439/607 |
| 5,674,085 | 10/1997 | Davis et al. | 439/188 |
| 5,685,739 | 11/1997 | Davis et al. | 439/607 |
| 5,718,605 | 2/1998 | Morikava | 439/607 |
| 5,725,386 | 3/1998 | Davis et al. | 439/79 |
| 5,842,886 | 12/1998 | Illg et al. | 439/607 |

FOREIGN PATENT DOCUMENTS

| | | | |
|---|---|---|---|
| 5-74523 | 3/1993 | Japan | H01R 13/648 |
| 8-315931 | 11/1996 | Japan | H01R 23/68 |
| 2 251 135 | 6/1992 | United Kingdom . | |
| WO 88/08627 | 11/1988 | WIPO | H01R 13/658 |
| WO 98/09353 | 3/1998 | WIPO | H01R 23/68 |

OTHER PUBLICATIONS

International Search Report from corresponding Great Britain application, 1 page, Jan. 15, 1999.

*Primary Examiner*—Paula Bradley
*Assistant Examiner*—Alexander Gilman

[57] ABSTRACT

The present invention provides a shielded connector which has a relatively small size and simple construction, and which at the same time allows for stable fastening of a shield member to a housing. Shielded connector (10) has a shield member (50), which is mounted along an outside surface of a housing (30). The shield member (50) has an upper wall (51) and a pair of side walls (58), which are positioned on both sides of the upper wall (51). When the shield member (50) is mounted on the housing (30), surface-mounting sections (57*b*), which are located in the same plane with the side walls (58), are passed through first sections of slots (35) formed in the housing (30), after which the surface-mounting sections (57*b*) are bent outward substantially at right angles. As a result, a mounting surface, which coincides with a bottom surface of the housing (30) is obtained; furthermore, the surface-mounting sections (57*b*) engage with portions of the housing (30) so that the shield member (50) is fastened to the housing (30).

18 Claims, 7 Drawing Sheets

SHIELDED CONNECTOR

FIELD OF THE INVENTION

The present invention relates to a shielded connector in which a metal shield member in the form of a metal plate is mounted on an outside surface of a housing.

BACKGROUND OF THE INVENTION

One example of a conventional shielded connector of this type is disclosed in Japanese Patent Application No. 5-74523. The disclosed shielded connector is constructed so as to be mounted on a circuit board. The metal shield member is formed by bending a metal plate, and is substantially C-shaped. Furthermore, the shield member has fastening means capable of accommodating screws in positions on both sides. Specifically, the shield member can be fastened to the circuit board by fastening means using screws. A plurality of engaging members, which are formed by stamping and forming so that the engaging members protrude inwardly, are disposed on the shield member. The engaging members are formed so that they are capable of engaging with shoulders located inside grooves formed in the outside surfaces of a housing.

However, in the shielded connector constructed as described above, the strength with which the shield member is supported on and fastened to the housing is weak; accordingly, there is a danger that the shield member may come loose in the process of handling prior to being mounted on the circuit board. Furthermore, especially in cases where the shield member is deformed by resilient engagement with a mating connector, it is desirable that the shield member be firmly fastened to the housing in order to improve the stability of the electrical connection with the mating connector following mounting on the circuit board.

Accordingly, the object of the present invention is to provide a shielded connector which has a relatively small size and is of simple construction, and which at the same time allows stable fastening of the shield member to the housing. In particular, the object of the present invention is to provide a shielded connector which can be surface-mounted on a circuit board.

SUMMARY OF THE INVENTION

The present invention is directed to a shielded connector which comprises a metal shield member having an upper wall and a pair of opposing side walls which extend substantially at right angles from both ends of the upper wall and which include fastening members that are used to fasten the connector to a circuit board. The shield member is mounted on an outside surface of a housing, a pair of slots, which can accommodate the side walls by allowing the side walls to pass therethrough are located in the housing, and the fastening members include surface-mounting sections, which are constructed by bending portions of the side walls that have passed through the slots substantially at right angles toward the outside.

Some of the surface-mounting sections of the side walls engage with the slots of the housing in the vicinity of lower ends of the slots. In this way, positioning of the surface-mounting sections is accomplished.

Securing sections, which are bent inward substantially at right angles after passing through the slots and which engage with a bottom portion of the housing, are disposed on each of the side walls of the shield member.

Portions of the side walls include tines, which are connected by soldering to through-holes in a circuit board.

The side walls include surface-mounting sections, which are formed by bending the side walls substantially at right angles. The slots in the housing include openings which allow the protrusion of the surface-mounting sections.

The slots are formed on both sides of the housing so that the slots extend from an intermediate position in the direction of height to a position located substantially at a lower end of the housing, and both ends of the housing on an upper side of the housing are positioned so that the ends substantially overlap with the positions of the bends between the upper wall and side walls of the shield member.

BRIEF DESCRIPTION OF THE DRAWINGS

Embodiments of the present invention will now be described by way of example with reference to the accompanying drawings in which.

DETAILED DESCRIPTION OF THE INVENTION

Figure 1:
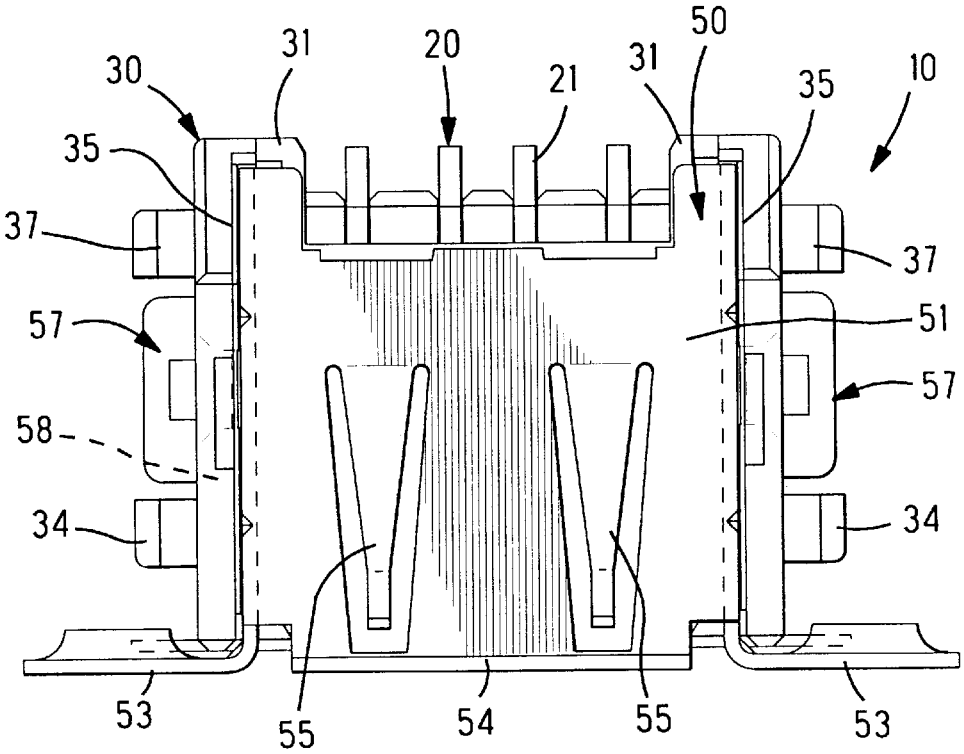
FIG. 1 is a top plan view of a shielded connector of the present invention.

In FIGS. 1 through 5, shielded connector 10 has a housing 30 which supports electrical contacts 20, and a shield member 50 which is fastened to the housing 30. The contacts 20 have surface-mounting sections 21, which protrude to the rear of the housing 30. The surface-mounting sections 21 are used for connection to a circuit board (not shown), and they are disposed between a pair of projections 31, which protrude from points near both side edges of the housing 30 at a rear end thereof so that the surface-mounting sections 21 do not protrude beyond the projections 31. As seen from FIG. 5, tines 29, which include the surface-mounting sections 21, are protected between a plurality of guide projections 42.

The shield member 50 includes an upper wall 51 and a pair of side walls 58, which extend from both side edges of the upper wall 51. The side walls 58 are accommodated in a pair of slots 35 in the housing 30. Details of the fastening of the shield member 50 to the housing 30 will be described later.

Figure 2:
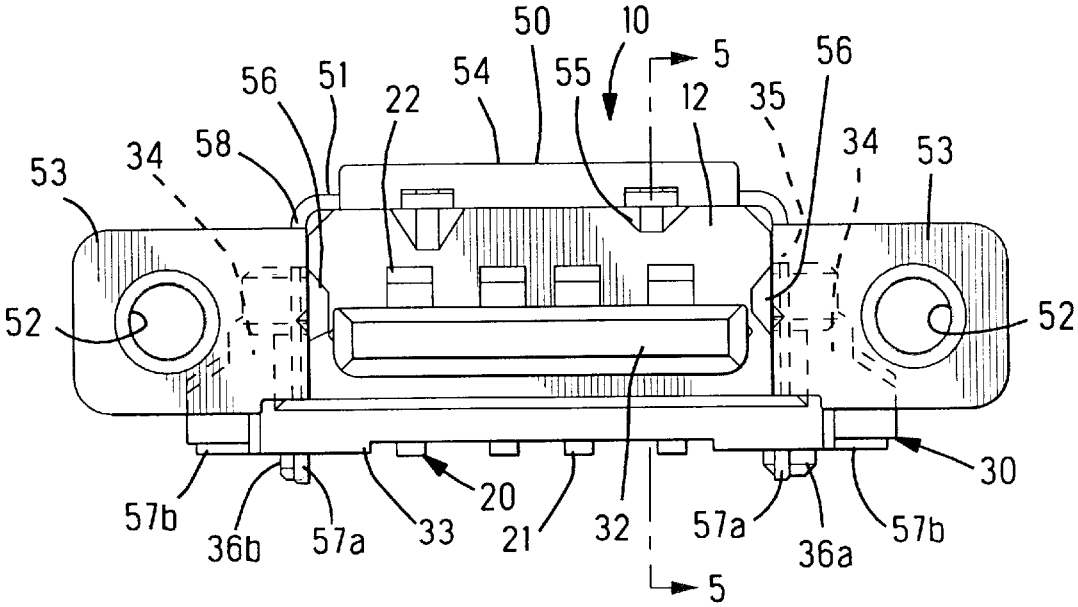
FIG. 2 is a front view of the shielded connector of FIG. 1.
Figure 3:
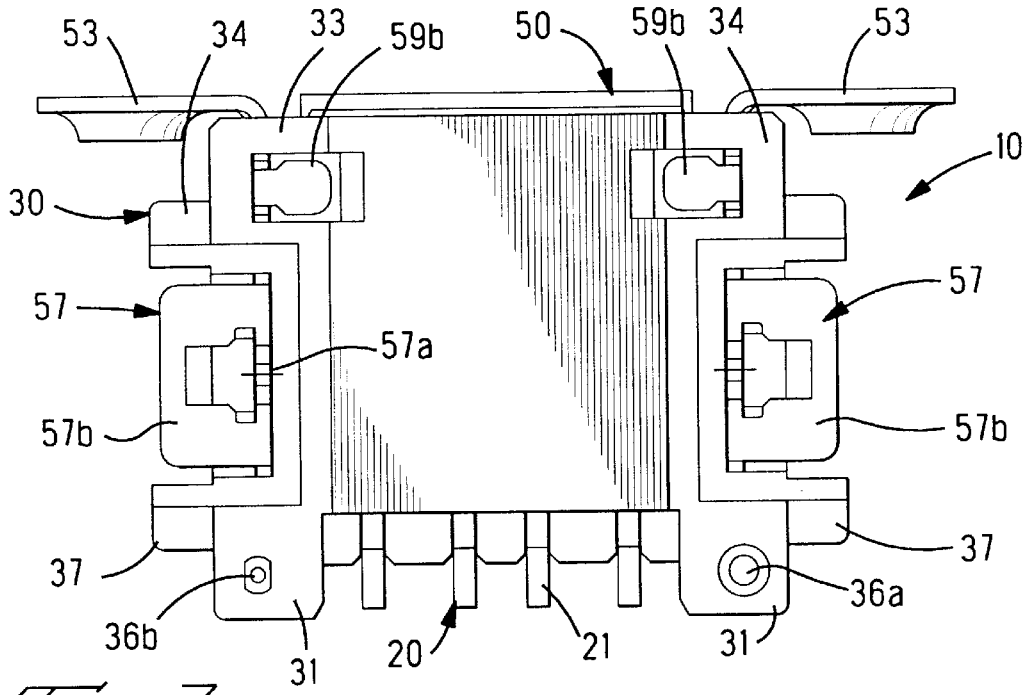
FIG. 3 is a bottom view of the shielded connector of FIG. 1.
Figure 4:
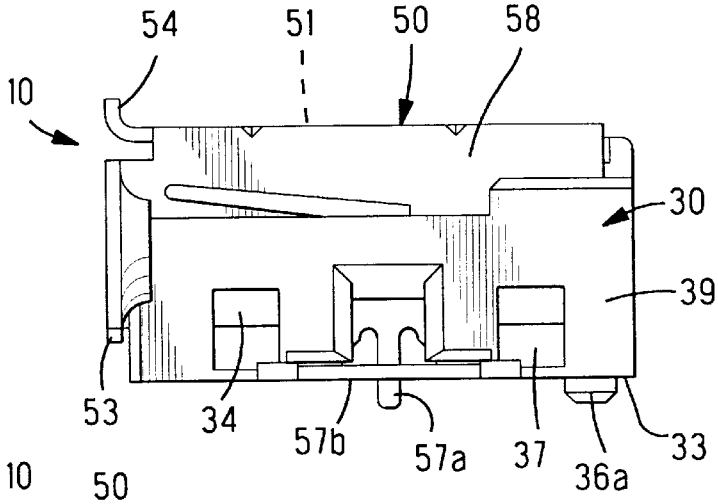
FIG. 4 is a side view of the shielded connector of FIG. 1.
Figure 5:
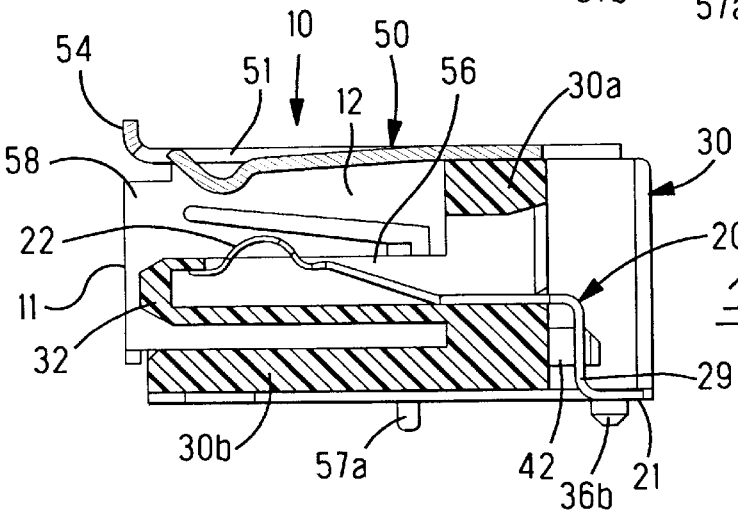
FIG. 5 is a longitudinal cross-sectional view of the shielded connector taken along line 5—5 of FIG. 2.
Figure 6:
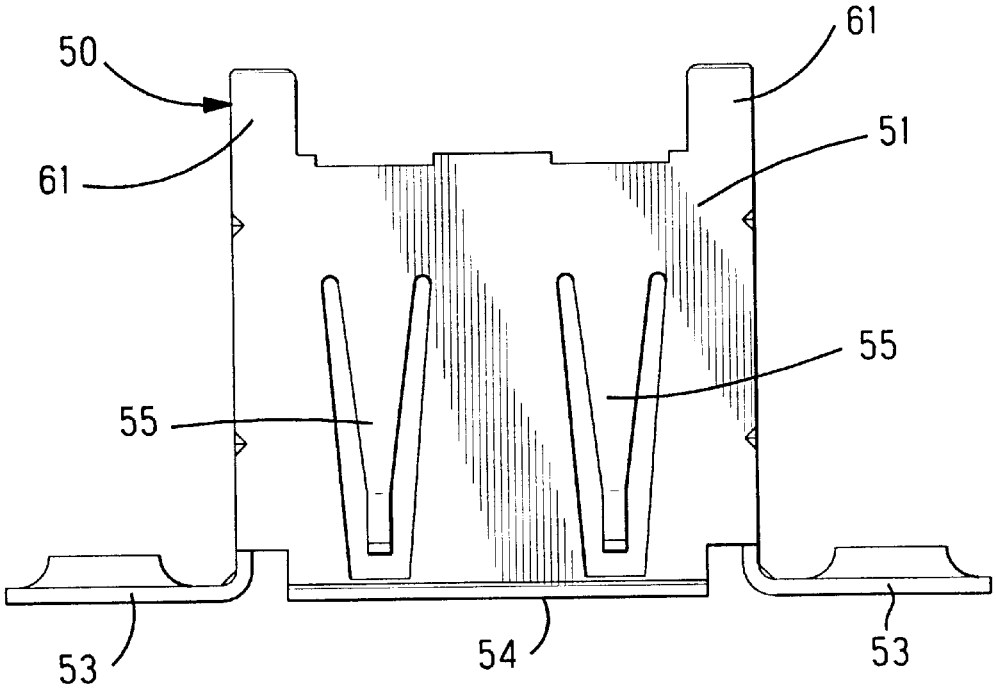
FIG. 6 is a top plan view of a metal shield member used on the shielded connector of FIGS. 1–5.
Figure 7:
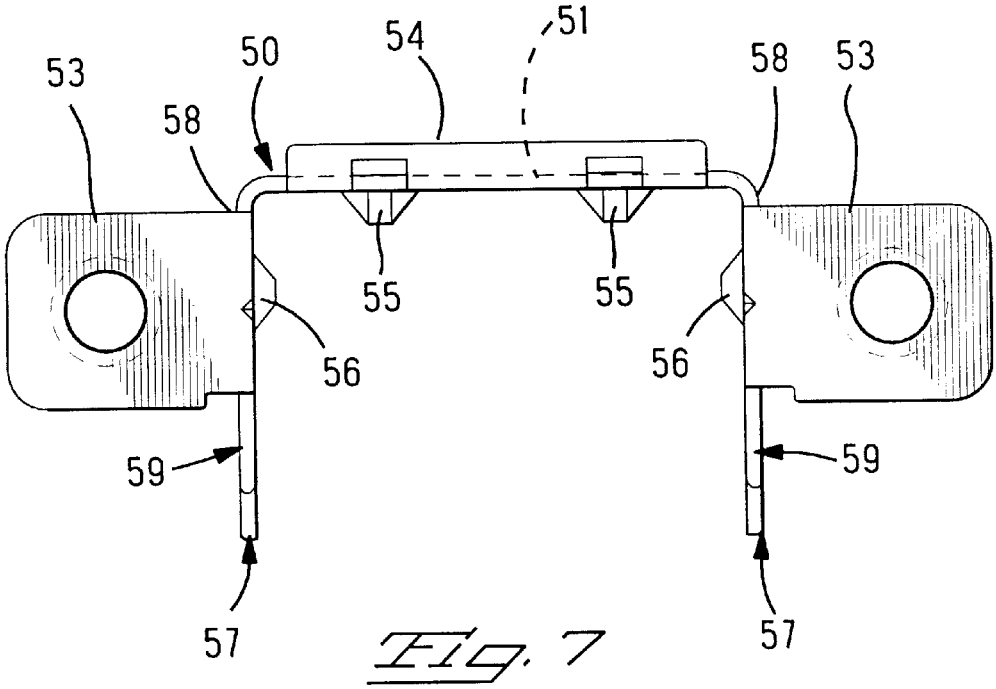
FIG. 7 is a front view of the shield member of FIG. 6.
Figure 8:
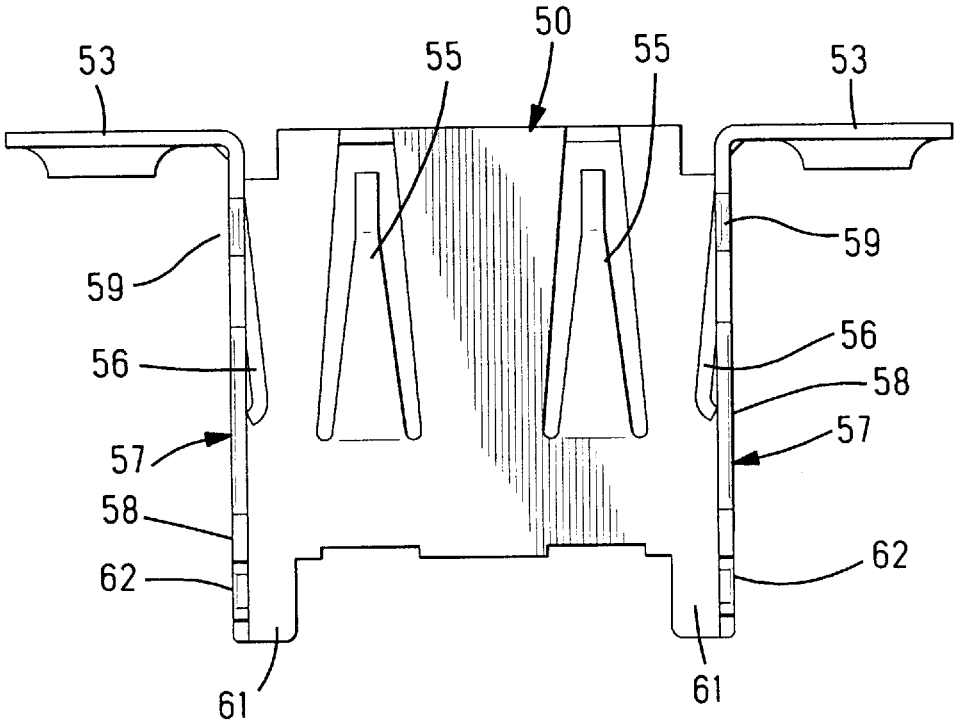
FIG. 8 is a bottom view of the shield member of FIG. 6.
Figure 9:
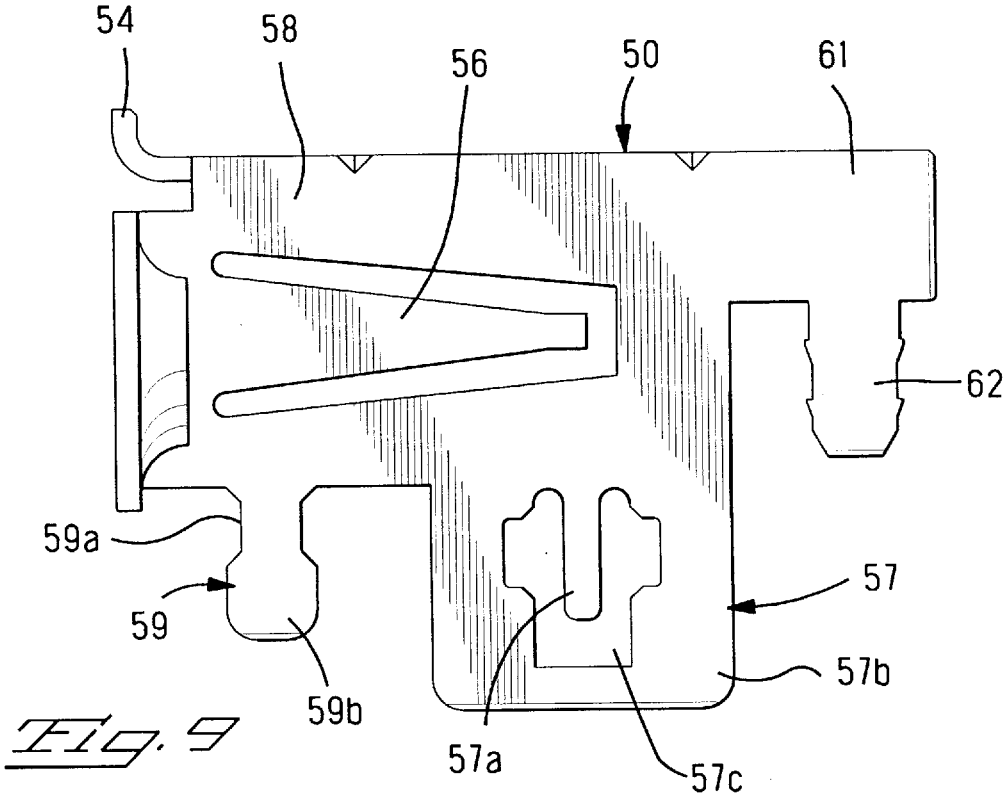
FIG. 9 is a side view of the shield member of FIG. 6.
Figure 10:
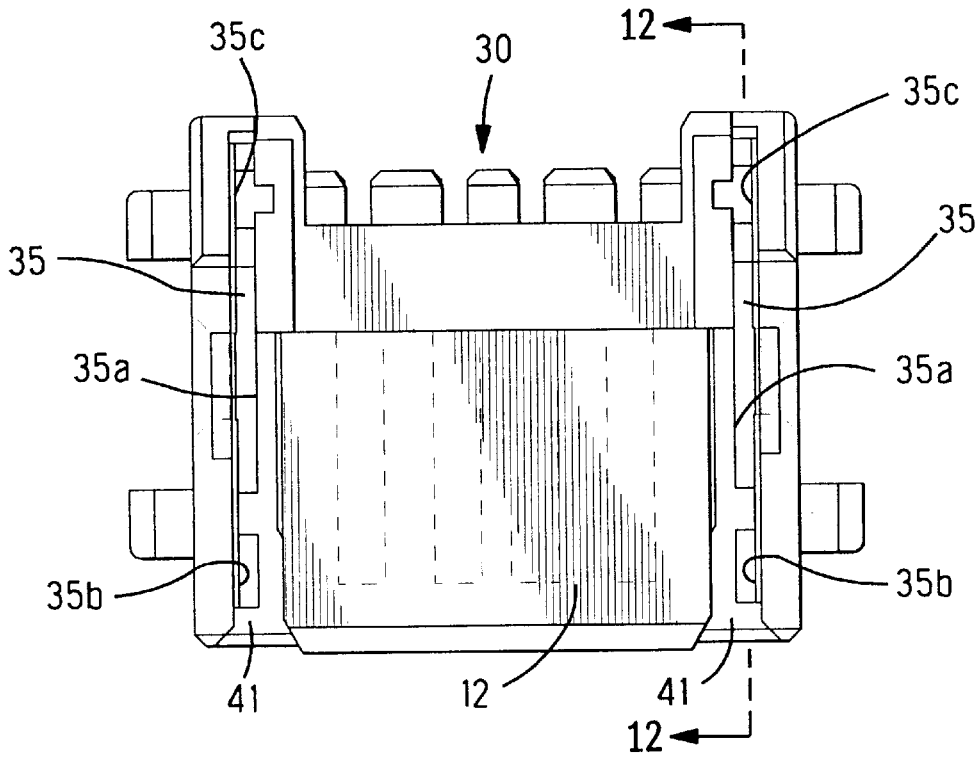
FIG. 10 is a top plan view of a housing used as part of the shielded connector of FIGS. 1–5.
Figure 11:
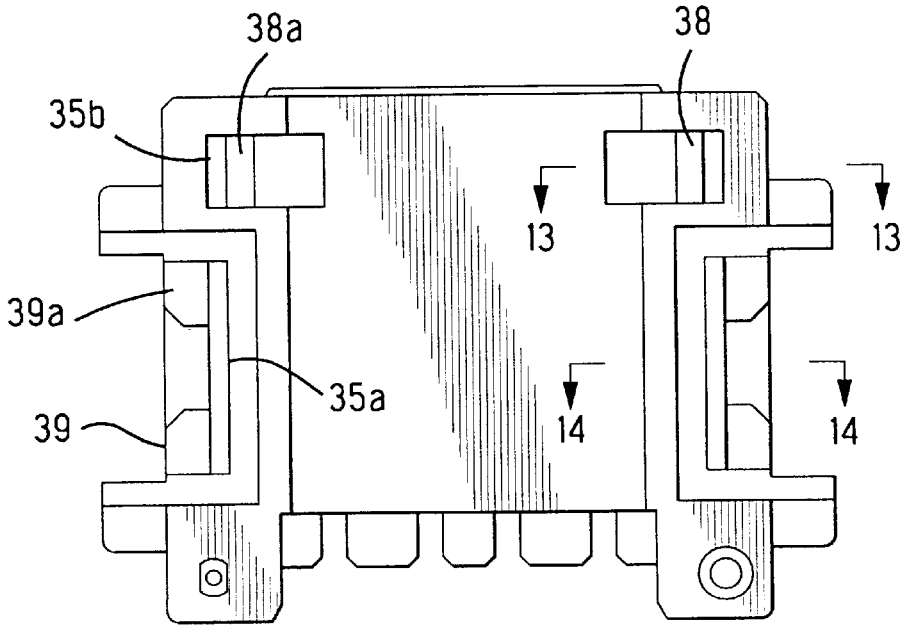
FIG. 11 is a bottom view of the housing of FIG. 10.

As shown in FIG. 2, the housing 30 does not have an upper wall on the side which receives the mating connector; instead, the upper wall 51 of the shield member 50 forms the upper wall of the shielded connector 10. Accordingly, a cavity 12, which accommodates the mating connector, is formed by the upper wall 51 and the housing 30. As seen from FIGS. 2 and 5, a protruding section 32, which protrudes in the direction of engagement from a rear wall 30*a* of housing 30 is disposed inside and along the cavity 12. Contact sections 22 of the contacts 20 are disposed along an upper side of the protruding section 32, and they extend above the protruding section 32. The shield member 50 has panel-attachment legs 53 in which holes 52 that accommodate panel-attachment screws are located on both sides of a mating end 11 of the shielded connector 10. The holes 52 are formed by subjecting the metal plates of the legs 53 to a drawing operation. An extension 54, which is in substantially the same plane as the legs 53, is formed from the upper wall 51 of the shield member 50 by bending it to a right angle. The extension 54 acts to stabilize the fastening of the shielded connector to a panel and electrical connection with the panel when the mating end of the shielded connector is secured onto the panel. The housing 30 has protruding ribs 34 adjacent the legs 53. Protruding ribs 34 prevent any deformation of the legs 53 due to the use of screws during attachment to the panel.

As shown in FIGS. 1 and 2, a pair of resilient arms 55, which are integrally formed as part of the upper wall 51 of shield member 50 so that they extend forward from a rear end and protrude into the interior of the cavity 12, are disposed along the top wall 51. The resilient arms 55 protrude toward the contact sections 22 of the contacts 20 inside the cavity 12. Furthermore, as shown in FIG. 2, resilient members 56 are also disposed along the side walls 58 of the shield member 50; the shape thereof will be described later.

As shown in FIGS. 1 through 4, fastening members 57 are integrally formed as part of the shield member 50 for the purpose of fastening the shielded connector 10 to a circuit board. Fastening members 57 include tines 57*a* which protrude from a bottom surface 33 of a bottom wall 30*b* of the housing 30, and surface-mounting sections 57*b*, which form mounting surfaces at a height position near the bottom surface 33. The tines 57*a* are formed by extending from the side walls 58, and the surface-mounting sections 57*b* are formed by bending the side walls 58 outwardly substantially at right angles thereto. The surface-mounting sections 57*b* are formed between the protruding ribs 34 and projections 37, which are positioned to the rear of the protruding ribs 34 with dimensions which are such that the surface-mounting sections 57*b* do not protrude beyond the outside ends of either the protruding ribs 34 or the projections 37. Furthermore, two posts 36*a* and 36*b* of different diameters, which are formed for the purpose of polarized positioning the housing 30 when the shielded connector 10 is mounted on the circuit board (not shown), extend outwardly from the bottom surface 33 of the housing 30.

Below, the structures of the respective members will be described along with the assembly of these members.

As shown in FIGS. 6–9, the shield member 50 is formed as a substantially C-shaped member by stamping and forming. The state shown in FIGS. 6–9 is the state prior to attachment to the housing 30. In this state, the surface-mounting sections 57*b* described above are in the same plane with the side walls 58. As shown, the tines 57*a* are positioned inside openings 57*c* formed inside the surface-mounting sections 57*b*. It is seen that the resilient members 56 described above extend rearward from the front end in an opposite direction from the resilient arms 55, so that the free ends of the resilient members 56 are at the rear ends thereof.

The side walls 58 have securing members 59, which extend further downward from the bottom ends of the side walls 58 near the front ends of the side walls 58. Each of the securing members 59 has a relatively narrow neck portion 59*a* and a plate portion 59*b*. Furthermore, extensions 61, which have L-shaped cross sections, are located at rear ends of the upper wall 51 and side walls 58. Press-fitting projections 62, which are used for press-fitting fastening to the housing 30, are located on bottom sides of the extensions 61.

Figure 12:
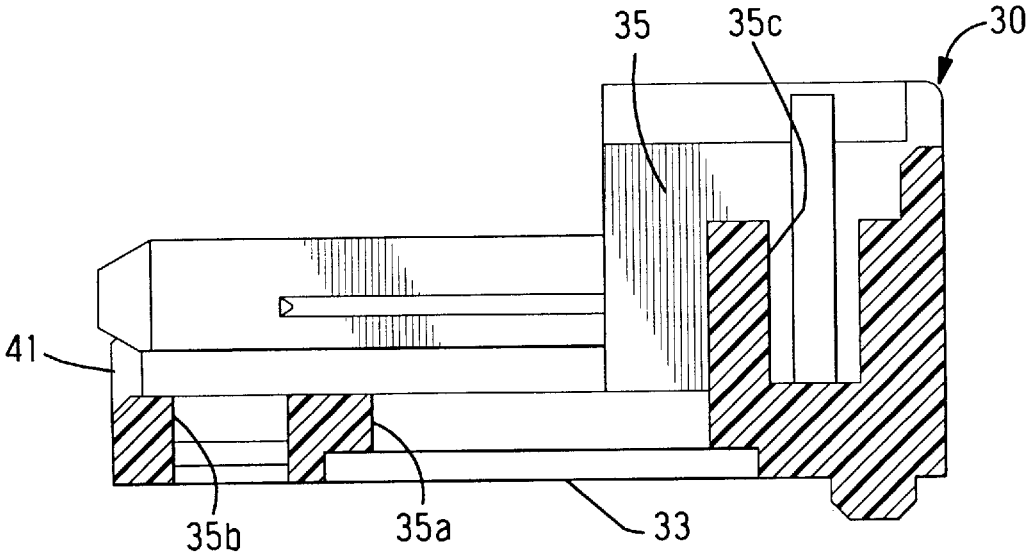
FIG. 12 is a longitudinal cross-sectional view taken along line 12—12 of FIG. 10.
Figure 13:
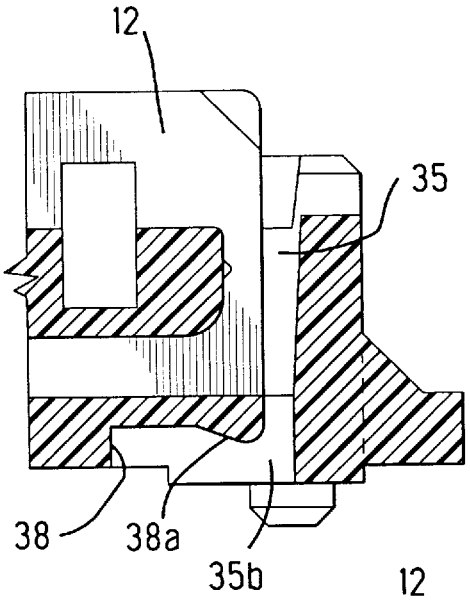
FIG. 13 is a cross-sectional view taken along line 13—13 in FIG. 11.
Figure 14:
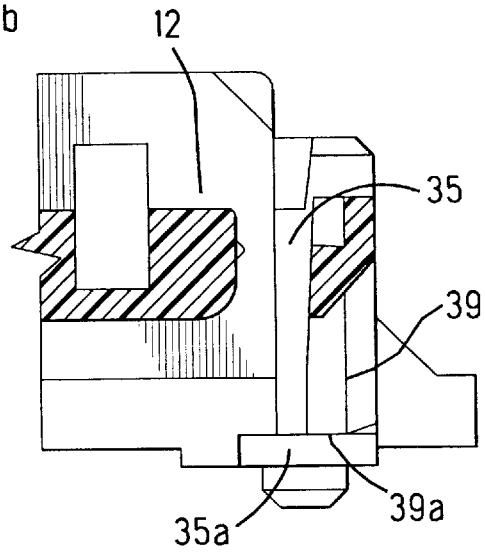
FIG. 14 is a cross-sectional view taken along line 14—14 in FIG. 11.

The shape of the housing 30 used in the shielded connector is shown in FIGS. 10–14. As shown in FIGS. 10–14, the slots 35 in the housing 30 each have a first section 35*a* and a second section 35*b*, which respectively extend through side walls 39 of the housing 30 at an intermediate position and a position near the front end of the housing. Each slot 35 also has an opening 35*c* which is used for receiving one of press-fitting projections 62 of shield member 50. In the shielded connector 10, the slots 35 communicate with the cavity 12. A recessed section 38 is located at a position on the inside of the bottom portion of each second section 35*b*. As shown in FIG. 13, a projection 38*a*, which includes a curved surface, is formed in each recessed section 38 in a position adjacent to the second section 35*b*. Furthermore, as shown in FIG. 14, a surface 39*a* is located at a bottom end of wall 39 positioned to the outside of each first section 35*a*. Moreover, as shown in FIG. 12, each of the openings 35*c* terminates at an intermediate position in the direction of height of the housing 30. Furthermore, the slots 35 include openings 41, which open at the mating end of the housing 30. Openings 41 allow the legs 53 to protrude to the outside when the shield member 50 is mounted on the housing 30.

When the shield member 50 is mounted on the housing 30, the side walls 58 of the shield member 50 are aligned with the slots 35 of the housing 30 and inserted from the top as was described above. In this case, the fastening members 57 which have surface-mounting sections 57*b* and tines 57*a* pass through the first sections 35*a*, and the securing members 59 pass through the second sections 35*b*. Afterward, only the surface-mounting sections 57*b* of the fastening members 57 are bent outward substantially at right angles along the surfaces 39*a* of the walls 39. Accordingly, as shown in FIGS. 1 through 5, the surface-mounting sections 57*b* are positioned so that they are substantially aligned with the bottom surface 33 of the housing 30, and the tines 57*a* are positioned so that they protrude from the bottom surface 33. Furthermore, the securing members 59 are bent inward, i. e., in the opposite direction from the surface-mounting sections 57*b*, substantially at right angles at the positions of the neck portions 59*a*. The neck portions 59*a* are bent along the curved surfaces of the projections 38*a*, so that the plate portions 59*b* are accommodated inside the recessed sections 38. Furthermore, the press-fitting projections 62 are press-fitted inside the openings 35*c*.

Thus, the shield member 50 is fastened to the housing 30. In particular, since the surface-mounting sections 57*b* are engaged with the surfaces 39*a* positioned near the bottom ends of the first sections 35*a* of the slots 35, there is no danger that the shield member 50 will slip off the housing 30. In addition, since the securing members 59 are bent inward in front of the surface-mounting sections 57*b*, which are bent outward as described above, and since fastening by press-fitting is accomplished by means of the press-fitting projections 62 to the rear of the surface-mounting sections 57*b*, the fastening of the shield member 50 to the housing 30 is made even stronger.

Figure 15:
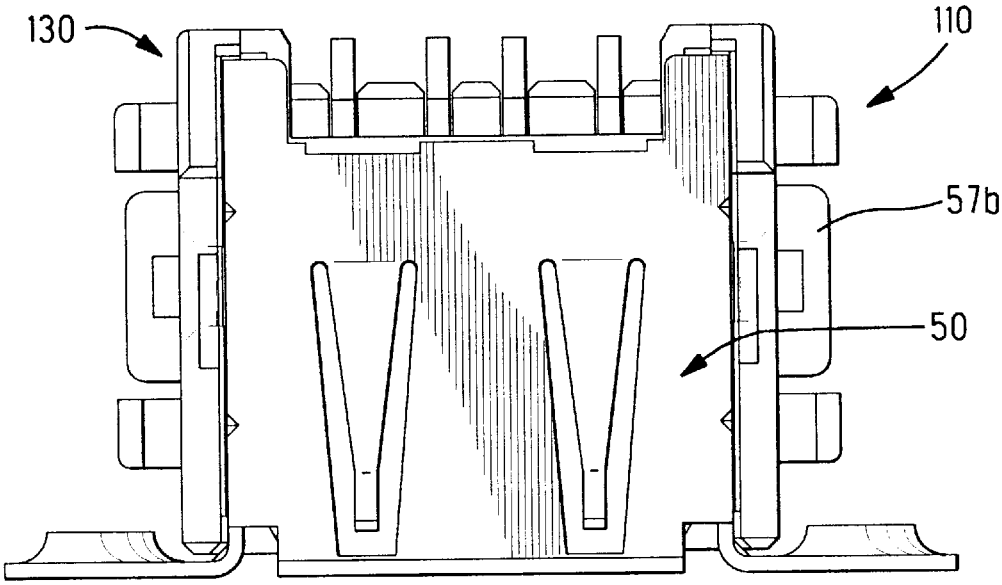
FIG. 15 is a top plan view of a shielded connector of an alternative embodiment of the present invention.
Figure 16:
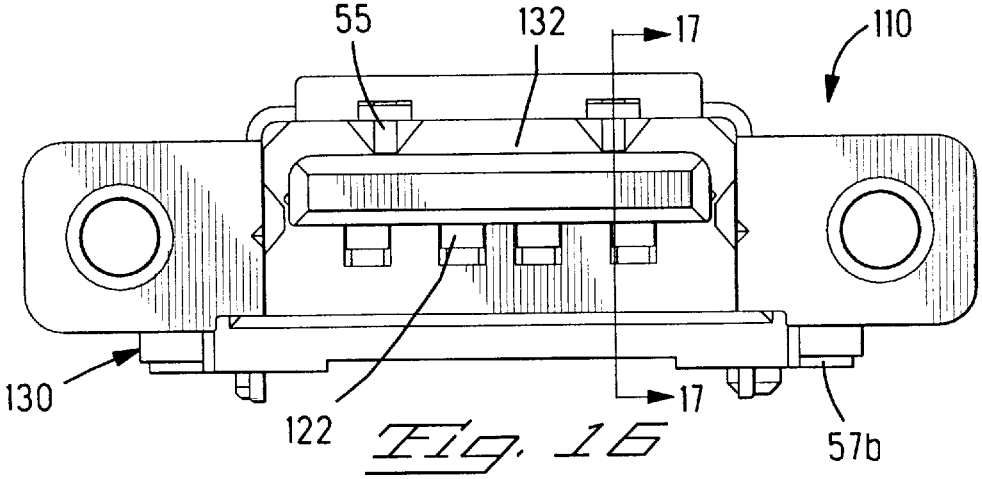
FIG. 16 is a front view of the shielded connector of FIG. 15.
Figure 17:
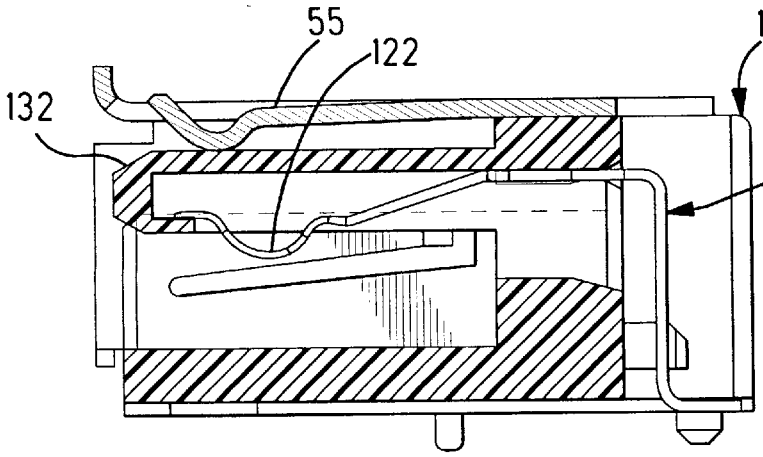
FIG. 17 is a longitudinal cross-sectional view taken along line 17—17 of FIG. 16.

A shielded connector constituting an alternative embodiment of the present invention is disclosed in FIGS. 15–17.

This shielded connector 110 has a shield member 50 which has the same shape as that of the shielded connector 10; furthermore, shielded connector 110 has substantially the same external shape as the shielded connector 10. However, shielded connector 110 differs from the shielded connector 10 in terms of the shapes of the housing and contacts. As shown in FIGS. 16 and 17, the housing 130 has a protruding section 132 at a relatively high position in the direction of height, and the contact sections 122 of the contacts 120 are disposed along the undersurface of protruding section 132. As shown, the contact sections 122 are arranged so that they protrude from an undersurface of the protruding section 132. The resilient arms 55 of the shield member 50 are arranged so that they substantially engage the protruding section 132. The shapes of the remaining parts are the same as in the shielded connector 10; accordingly, a description thereof is omitted.

In the shielded connector of the present invention, a pair of slots which can accommodate side walls of a shield member by allowing the side walls to pass therethrough are formed in a housing, and fastening members, which are used to fasten the shield member to a circuit board, include surface-mounting sections, which are constructed by bending portions of the side walls that have passed through the slots substantially at right angles toward the outside. Accordingly, there is no danger that the shield member will slip off the housing prior to mounting on the circuit board; furthermore, the shield member can firmly fasten the housing to the circuit board following mounting. Moreover, this shielded connector is of relatively simple construction, and assembly of the connector is also easy.

We claim:

1. A shielded electrical connector, comprising an insulated housing having side walls and a rear wall extending upwardly from a bottom wall, the side walls having slots extending therethrough;

a metal shield on the housing having an upper wall and side walls extending downwardly from ends thereof, the upper wall providing an upper wall for the housing;

fastening members extending from bottom ends of the side walls of the metal shield and extend through the slots in the side walls of the insulated housing and include mounting members extending at right angles relative to the side walls of the insulated housing for mounting the connector onto a circuit board.

2. A shielded electrical connector as claimed in claim 1, wherein openings are located in the side walls of the insulated housing in alignment with the slots in which press-fitting projections of the metal shield are disposed.

3. A shielded electrical connector as claimed in claim 1, wherein the fastening members include openings in which tines are located and surface-mounting sections.

4. A shielded electrical connector as claimed in claim 1, wherein the slots include first sections for receiving the fastening members and second sections for receiving securing members.

5. A shielded electrical connector as claimed in claim 4, wherein recessed sections are disposed in the bottom wall in communication with the second sections of the slots so that plate portions of the securing members can be bent thereinto.

6. A shielded electrical connector as claimed in claim 5, wherein projections having a curved surface are located in the recessed sections.

7. A shielded electrical connector as claimed in claim 1, wherein the upper wall of the metal shield has resilient arms extending from a rear end of the metal shield toward a front end thereof and extending inwardly within a cavity.

8. A shielded electrical connector as claimed in claim 7, wherein the side walls of the metal shield include resilient members extending from the front end of the shield member toward the rear end thereof.

9. A shielded electrical connector as claimed in claim 7, wherein a protruding section extends from the rear wall of the housing along the cavity toward the front end of the metal shield member.

10. A shielded electrical connector as claimed in claim 9, wherein electrical contacts are secured in the housing and include surface-mounting portions extending outwardly from the rear wall of the housing and contact sections extending along the cavity with free ends of the contact sections being disposed within the protruding section.

11. A shielded electrical connector, comprising an insulated housing having side walls and a rear wall extending upwardly from a bottom wall, the side walls having slots extending therethrough;

a metal shield on the housing having an upper wall and side walls extending downwardly from ends thereof, the upper wall providing an upper wall for the insulated housing; and fastening members including mounting members and securing members extending from bottom ends of the side walls of the metal shield, the mounting members extending through first sections of the slots and extending at right angles relative to the side walls of the insulated housing for mounting the connector onto a circuit board, the securing members extending through second sections of the slots.

12. A shielded electrical connector as claimed in claim 11, wherein openings are located in the side walls of the insulated housing in alignment with the slots in which press-fitting projections of the metal shield are disposed.

13. A shielded electrical connector as claimed in claim 11, wherein the mounting members include openings in which tines are located and surface-mounting sections.

14. A shielded electrical connector as claimed in claim 11, wherein recessed sections are disposed in the bottom wall in communication with the second sections of the slots so that plate sections of the securing members are bent thereinto.

15. A shielded electrical connector as claimed in claim 14, wherein projections having a curved surface are located in the recessed sections.

16. A shielded electrical connector as claimed in claim 11, wherein the upper wall of the metal shield has resilient arms extending from a rear end of the metal shield toward a front end thereof and extending inwardly within a cavity.

17. A shielded electrical connector as claimed in claim 16, wherein a protruding section extends from the rear wall of the insulated housing along the cavity toward the front end of the metal shield.

18. A shielded electrical connector as claimed in claim 17, wherein electrical contacts are secured in the insulated housing and include contact sections extending along the cavity with free ends of the contact sections being disposed within the protruding section.

* * * * *